US009101259B2

(12) United States Patent
Dirnberger et al.

(10) Patent No.: US 9,101,259 B2
(45) Date of Patent: Aug. 11, 2015

(54) DOOR LOCK FOR A DISHWASHING MACHINE

(75) Inventors: Albert Dirnberger, Neunburg vorm Wald (DE); Georg Spiessl, Altendorf (DE); Peter Nitsche, Beilngries (DE); Markus Lang, Neunburg vorm Wald (DE)

(73) Assignee: emz-Hanauer GmbH & Co. KGaA (DE)

( * ) Notice: Subject to any disclaimer, the term of this patent is extended or adjusted under 35 U.S.C. 154(b) by 556 days.

(21) Appl. No.: 13/397,755

(22) Filed: Feb. 16, 2012

(65) Prior Publication Data

US 2013/0049376 A1 Feb. 28, 2013

(30) Foreign Application Priority Data

Feb. 18, 2011 (DE) ..... 10 2011 011 662

(51) Int. Cl.

*E05C 19/06* (2006.01)
*A47L 15/42* (2006.01)
*E05C 19/02* (2006.01)
(Continued)

(52) U.S. Cl.

CPC ..... *A47L 15/4259* (2013.01); *E05C 19/02* (2013.01); *E05C 19/026* (2013.01); *D06F 37/42* (2013.01); *D06F 39/14* (2013.01); *E05B 17/2007* (2013.01); *E05B 47/0012* (2013.01); *E05B 47/02* (2013.01); *E05B 2047/0069* (2013.01)

(58) Field of Classification Search

CPC ..... E05C 19/063; E05C 9/1858
USPC ..... 292/14, 15, 17, 19, 23, 201, 279, 280, 292/DIG. 69
See application file for complete search history.

(56) References Cited

U.S. PATENT DOCUMENTS 618,895 A * 2/1899 Almonte ..... 292/19
650,059 A * 5/1900 Munday ..... 292/17
(Continued)

FOREIGN PATENT DOCUMENTS

DE 3113205 A1 * 10/1982 ..... E05C 15/00
DE 102004023608 A1 12/2004
(Continued)

OTHER PUBLICATIONS

Office action from German Patent Office in co-pending German application listing prior art.
(Continued)

*Primary Examiner* — Carlos Lugo
(74) *Attorney, Agent, or Firm* — Robert R. Deleault, Esq.; Mesmer & Deleault, PLLC

(57) ABSTRACT

A door lock for a dishwashing machine includes a lock housing, a pair of closing arms being held in and projecting from the lock housing and having free arm portions projecting from the lock housing that are deflectable relative to one another from a relative normal position in a first deflection direction counter to the action of a resetting spring arrangement, and a closing mouth, into which the free arm portions engage during closing of the door, having deflection surfaces encountered by the free arm portions during engagement into the closing mouth and which bring about a relative deflection of the free arm portions counter to the resetting action of the resetting spring arrangement, where the free arm portions during further engagement is move past the deflection surfaces and in so doing experience an at least partial resetting in the direction of their relative normal position.

19 Claims, 16 Drawing Sheets

(51) Int. Cl.

| | |
|---|---|
| *E05C 19/00* | (2006.01) |
| *D06F 37/42* | (2006.01) |
| *D06F 39/14* | (2006.01) |
| *E05B 17/20* | (2006.01) |
| *E05B 47/00* | (2006.01) |
| *E05B 47/02* | (2006.01) |

(56) References Cited

U.S. PATENT DOCUMENTS

| | | | | | |
|---|---|---|---|---|---|
| 780,192 | A | * | 1/1905 | Jones | 213/90 |
| 1,691,724 | A | * | 11/1928 | Kruschka | 292/18 |
| 2,502,607 | A | * | 4/1950 | Vinton | 292/23 |
| 2,594,582 | A | | 4/1952 | Quinn | |
| 2,749,163 | A | * | 6/1956 | Loeb | 292/17 |
| 2,772,106 | A | * | 11/1956 | Semelka | 292/18 |
| 2,837,361 | A | * | 6/1958 | Loeb | 292/15 |
| 2,857,191 | A | * | 10/1958 | Buchholtz | 292/17 |
| 4,672,725 | A | * | 6/1987 | Kasai | 24/625 |
| 4,927,996 | A | * | 5/1990 | Genbauffe et al. | 219/413 |
| 5,062,668 | A | * | 11/1991 | Onderka et al. | 292/25 |
| 5,544,924 | A | * | 8/1996 | Paster | 292/6 |
| 5,647,618 | A | | 7/1997 | Lamberth | |
| 5,711,554 | A | * | 1/1998 | Brown et al. | 292/19 |
| 6,168,217 | B1 | * | 1/2001 | Kruger et al. | 292/341.16 |
| 6,282,931 | B1 | * | 9/2001 | Padiak et al. | 70/279.1 |
| 6,325,427 | B1 | * | 12/2001 | Daoud | 292/27 |
| 6,739,633 | B2 | * | 5/2004 | Holloway et al. | 292/199 |
| 6,773,042 | B2 | * | 8/2004 | Spurr et al. | 292/216 |
| 6,954,992 | B2 | * | 10/2005 | Hwang | 34/108 |
| 7,032,939 | B2 | | 4/2006 | Magnusson | |
| 7,299,809 | B2 | * | 11/2007 | Kang | 134/57 DL |
| 7,322,127 | B2 | * | 1/2008 | Hwang | 34/603 |
| 8,104,848 | B2 | * | 1/2012 | Yoon | 312/222 |
| 8,702,134 | B2 | * | 4/2014 | Lesjak | 292/340 |
| 2005/0194795 | A1 | | 9/2005 | Hapke et al. | |

FOREIGN PATENT DOCUMENTS

| | | | | | |
|---|---|---|---|---|---|
| DE | 102006037494 | B4 | | 7/2008 | |
| EP | 337220 | A2 | * | 10/1989 | A45D 40/22 |
| GB | 414188 | | * | 8/1934 | |
| PL | 383102 | A1 | | 2/2008 | |

OTHER PUBLICATIONS

Search report translation from Polish Patent Office in co-pending Polish application listing prior art.

* cited by examiner

DOOR LOCK FOR A DISHWASHING MACHINE

BACKGROUND OF THE INVENTION

1. Field of the Invention

The present invention relates generally to a door lock for a dishwashing machine or the like as well as to a dishwashing machine having such a door lock.

2. Description of the Prior Art

With the aid of such a door lock, the door of the dishwashing machine may be kept closed for example during a washing operation and, when required, re-opened, for example after the washing operation.

Door locks for dishwashing machines are known, which are fitted in the upper part of the appliance housing and engage with a closing lug down into a closing trough of the door. This is used to keep the door closed during the washing operation, even if an attempt is made to open it. Without releasing the door lock the door may be opened only with a considerable expenditure of force. Improper opening of the door by applying a high expenditure of force may lead to damage of the door lock. Such a door lock is known for example from DE 102006037494 of the applicant. These known door locks are of a complex mechanical design.

With the aid of such door locks, the door is to be reliably kept closed during the washing operation since opening during the washing operation can lead to injuries, such as scalding, as a result of hot steam escaping from the door aperture.

SUMMARY OF THE INVENTION

Dishwashing machines, for which the presently considered door lock is suitable, comprise a housing with a door aperture that is closable by means of a door fitted movably on the dishwashing machine (appliance housing). The door lock may be fitted in the appliance housing or in the door. It is also possible for elements of the door lock to be disposed in the appliance housing and other elements in the door.

It is an object of the present invention to provide a simply designed door lock for a dishwashing machine and a dishwashing machine having such a door lock, by means of which the door of the dishwashing machine is reliably kept closed during the washing operation.

This object is achieved by the subject matter of the independent claims. Advantageous embodiments emerge from the dependent claims.

The door lock according to the invention for a dishwashing machine comprises a lock housing and a pair of closing arms, which are held in and project from the lock housing. Free arm portions of the closing arms that project from the lock housing are deflectable relative to one another from a relative normal position in a relative first deflection direction counter to the action of a resetting spring arrangement. The door lock further comprises a closing mouth, into which the free arm portions of the closing arms engage during closing of the door of the dishwashing machine. Disposed on the closing mouth are deflection surfaces, which the free arm portions encounter during engagement into the closing mouth and which bring about a relative deflection of the free arm portions counter to the resetting action of the resetting spring arrangement. The free arm portions upon further engagement move past the deflection surfaces and in so doing experience an at least partial resetting in the direction of their relative normal position.

The lock housing may be disposed together with the closing arms for example on an appliance housing of the dishwashing machine, while the closing mouth may be disposed on the door of the dishwashing machine. It is however also conceivable to reverse this arrangement and provide the closing mouth on the appliance housing and the lock housing plus the closing arms on the door. Independently of this arrangement it is advantageous to dispose the lock housing plus the closing arms and the closing mouth at mutually corresponding positions on the door and the appliance housing that lie as precisely opposite one another as possible in the closed state of the door. This guarantees an easier engagement of the free arm portions of the closing arms into the closing mouth.

The deflectability of the free arm portions may be based at least partially on an inherent flexibility of the closing arms. For this purpose the closing arms may be formed from a flexible material. Alternatively or additionally the deflectability of the free arm portions may be based at least partially on a movable, for example pivotable, mounting of the closing arms in the lock housing. It is accordingly possible to configure the closing arms completely rigid and to mount the rigid closing arms pivotably on the lock housing. It is equally conceivable to equip the closing arms with a specific inherent flexibility and additionally mount them pivotably on the lock housing.

The free arm portions of the closing arms may carry roll-mounted rolling elements that guarantee a rolling contact of the free arm portions with the deflection surfaces. The rolling elements are disposed in particular on the free ends of the free arm portions. By means of the rolling elements the free arm portions may slide with less friction along the deflection surfaces. As an alternative to the rolling elements, the free ends of the free arm portions may have sliding surfaces that travel along the deflection surfaces during the engagement of the arm portions into the closing mouth. By replacing the sliding surfaces with rolling elements, the sliding friction between the closing arms and the deflection surfaces may be reduced. This then likewise reduces the expenditure of force for introducing and removing the closing arms into and/or from the closing mouth.

According to a first development of the door lock the free arm portions of the closing arms are preferably deflectable towards one another from their relative normal position. The deflection surfaces of the closing mouth accordingly run preferably in a funnel-like manner towards one another.

According to a first variant of this first development, the resetting spring arrangement comprises a compression spring, such as a helical compression spring. The compression spring in this first variant is disposed preferably in longitudinal direction of the closing arms between the respective ends of the closing arms and extends transversely of the closing arms. The closing arms in the relative normal position may be held for example at a normal spacing from one another. When during the closing operation of the door the closing arms engage into the closing mouth (independently of whether the closing mouth disposed on the door is moved relative to the closing arms disposed on the appliance housing or whether the closing arms disposed on the door are moved relative to the closing mouth disposed on the appliance housing), the free arm portions are pressed together from their spaced-apart normal position counter to the action of the compression spring by the deflection surfaces running in a funnel-like manner towards one another. The further the free arm portions engage into the closing mouth, the more the free arm portions are pressed together in accordance with the shape of the deflection surfaces. This enables the introduction of the closing arms into the closing mouth.

According to a second variant of this first development, the resetting spring arrangement comprises a tension spring such as a helical tension spring. As in the first variant, the closing arms may be held in the relative normal position for example at a normal spacing from one another. In a departure from the first variant, in the second variant the position of the mounting of the closing arms and the position of the spring in longitudinal direction of the closing arms may be transposed. Preferably in the second variant the tension spring is disposed on the respective other ends than the free ends of the closing arms and extends transversely of the closing arms. Thus, the tension spring may hold the closing arms in the normal position. When during the closing operation of the door the closing arms engage into the closing mouth, the free arm portions are pressed together from their spaced-apart normal position counter to the action of the tension spring by the deflection surfaces that run in a funnel-like manner towards one another. The further the free arm portions engage into the closing mouth, the more the free arm portions are pressed together in accordance with the shape of the deflection surfaces. This enables the introduction of the closing arms into the closing mouth.

In line with the first development, the deflection surfaces running in a funnel-like manner towards one another terminate preferably in an end region of the closing mouth. As in this case a force is no longer exerted on the free arm portions counter to the action of the compression spring (first variant) or the tension spring (second variant), the arm portions are deflected away from one another (in a second deflection direction) by the action of the compression spring and/or the tension spring and the free ends of the arm portions may be received by cavities formed in the end region of the closing mouth. A connection between the arm portions and the closing mouth is thereby formed, which is based at least partially on a frictional connection. For example, for releasing this frictional connection a force of between 50 and 150, for example between 80 and 120, and preferably of 100 Newtons, is required. Even if this force is exceeded, no damage to the door lock occurs, rather the frictional connection is released.

According to a reversal of the functional principle of the first development, according to a second development the resetting spring arrangement may comprise a tension spring, which is disposed at a position between the closing arms that corresponds to the compression spring according to the first variant of the first development. According to this development the free arm portions are deflectable away from one another as a first deflection direction. The deflection surfaces in the context of this second development are formed in a pyramid- or cone-like manner in the centre of the closing mouth and during the engagement process press the arm portions apart from one another counter to the action of the tension spring. According to this reverse functional principle the deflection surfaces extending in a cone-like manner away from one another terminate in the end region of the closing mouth, with the result that the free arm portions are pressed together in the end region of the closing mouth for example by the action of the tension spring. The free ends of the arm portions may be received by cavities formed in the end region and hence form a frictional connection with the end region.

In the normal position of the free arm portions the mutual spacing of the free arm portions of the closing arms may be determined by a connecting bridge arrangement that is applied to both closing arms. The connecting bridge arrangement may for example block the free arm portions in the normal position thereof to prevent a relative movement in the second relative deflection direction that is opposed to the first relative deflection direction. However, in the normal position the free arm portions may for example possess motional clearance relative to the lock housing in a direction of motion corresponding to the second relative deflection direction. For example, the blocking of the free arm portions by means of the connecting bridge arrangement may prevent the free arm portions from being deflected relative to one another in the second deflection direction. In this case, the free arm portions connected to one another by the connecting bridge arrangement may be moved simultaneously in the direction of motion. This motional clearance ensures that, even if the arm portions and the closing mouth do not lie ideally opposite one another, an engagement of the arm portions into the closing mouth is guaranteed.

The door lock may further comprise a control element configured for manual actuation, which is displaceable between a first position and a second position relative to the lock housing and which guarantees in its first position a facilitated relative deflection of the arm portions of the closing arms in the first relative deflection direction and in its second position an at least—compared to the first position of the control element—more difficult relative deflection of the arm portions in the first relative deflection direction. For this purpose, in the closed state of the door the control element may be displaceable from its first position into its second position and vice versa. The more difficult relative deflection of the arm portions in the first deflection direction may be achieved for example in that the length of the active lever arms of the free arm portions is reduced by the control element. The control element for this purpose may comprise a blocking element, which is disposed preferably between the closing arms. If the first deflection direction corresponds to a direction of the closing arms towards one another, the active lever arms of the free arm portions become shorter, the closer the blocking element is to the free ends of the arm portions.

The control element may for example in its first position enable a pivoting of the closing arms and in its second position prevent the closing arms from pivoting. In the event of blocking of the closing arms, a deflectability of the closing arms may exist due to inherent flexibility.

The door lock may further comprise a contacting element, which may be activated by one of the free arm portions of the closing arms in order thereby to actuate a switch disposed in the door lock. For example, the contacting element may comprise a contacting pin that may be moved by one of the free arm portions transversely of the direction of introduction of the arm portions into the closing mouth when the arm portions upon further engagement into the closing mouth are deflected partially back in the direction of their relative normal position. As a result of the transverse movement of the contacting pin, a microswitch for example disposed as a switch in the door lock may be actuated. The actuation of the microswitch into its new position may then be detected and on this basis the closed state of the door may be deduced.

The door lock may also comprise an opening unit that enables an automatic opening of the dishwashing machine once the washing operation has finished and the drying operation is initiated. For this purpose the opening unit may be configured to convert a rotary motion brought about by a drive unit, such as an electric motor, to a translatory motion, which acts upon the closing arms, in such a way as to bring about a deflection of the free arm portions relative to one another counter to the action of the resetting spring arrangement. For example, the opening unit may comprise a threaded rod, which extends transversely of the closing arms through the closing arms and is rotatable with the aid of the drive unit, such as the electric motor, wherein load transfer elements such as slide blocks, which are disposed in a rotationally fixed manner on the threaded rod, as a result of rotation of the threaded rod bring about a deflection of the free arm portions relative to one another counter to the action of the resetting spring arrangement. The threaded rod has for example a contradirectional righthand-/lefthand thread. It is for example conceivable that a control unit responsible for controlling the dishwashing machine or a control unit provided in the door lock (which may be connected for example to the control unit of the dishwashing machine) detects that the washing operation has finished and a drying operation is to be initiated and activates the drive unit accordingly. The drive unit then brings about a rotary motion of the threaded rod, which via the thread is movable relative to the closing arms. During rotation of the threaded rod the load transfer elements connected in a rotationally fixed manner to the threaded rod act upon the closing arms in such a way that the free arm portions are moved relative to one another counter to the action of the resetting spring arrangement. Thus, the free arm portions move preferably into a position, in which their connection to the cavities of the end portion of the closing mouth is released. Then the drive unit is for example stopped and the door may be opened with a reduced expenditure of force.

The drive unit may for example be controlled by the control unit in such a way that the free arm portions are moved (with the aid of the load transfer elements) into a position, in which they are pressed together to an extent that enables an at least almost entirely friction-free opening of the door lock. Alternatively the control unit may control the drive unit in such a way that the free arm portions are pressed together only partially and to such an extent that the expenditure of force for opening the door is reduced (for example by a few Newtons). The reduction of the expenditure of force may for example be selected by a user via an input unit of the dishwashing machine, wherein the control unit then brings about a corresponding rotation of the drive unit. In this way, as a kind of comfort access, an easier opening of the door may be achieved.

Furthermore, an opening element may be additionally provided, such as for example an opening pin or ejection pin that is capable of pressing the door in opening direction. The opening element may be held in a normal position counter to the spring action of a spring arrangement acting in the direction of extent of the closing arms and, upon release of the spring arrangement, as a result of the spring action may experience a movement in the direction of the direction of extent of the closing arms. It is accordingly conceivable for the opening element to be initially held in the normal position counter to the spring action of the spring arrangement. If for example the control unit then detects that the washing operation has finished, the control unit may then instruct the (previously described) pressing-together of the free arm portions. After this operation the free ends of the free arm portions are at least partially released from the cavities. If the control unit then instructs for example a release of the spring arrangement, the opening element is moved by the spring action in the direction of extent of the closing arms, which results in the door being slightly pressed open by the opening element. The drying operation may then be carried out more efficiently with the door open.

The invention further relates to a dishwashing machine having the presently described door lock. Given a situation of proper fitting of the door lock in the dishwashing machine, the free arm portions (16*a*, 16*b*) prior to engagement into the closing mouth (32) are oriented preferably in the direction of a rear side of the door (3) and in the direction of the closing mouth (32).

The invention is further described below with reference to preferred embodiments.

DETAILED DESCRIPTION OF THE PREFERRED EMBODIMENT

The preferred embodiments of the present invention are illustrated in FIGS. 1-8. FIGS. 1*a*, 1*b*, 2*a* and 2*b* show diagrammatic representations of various views of a door lock according to a first embodiment of the present invention. The door lock according to the first embodiment is shown in a closed state in FIGS. 1*a*, 1*b* and 2*b* and in an open state in FIG. 2*a*.

Figure 1A:
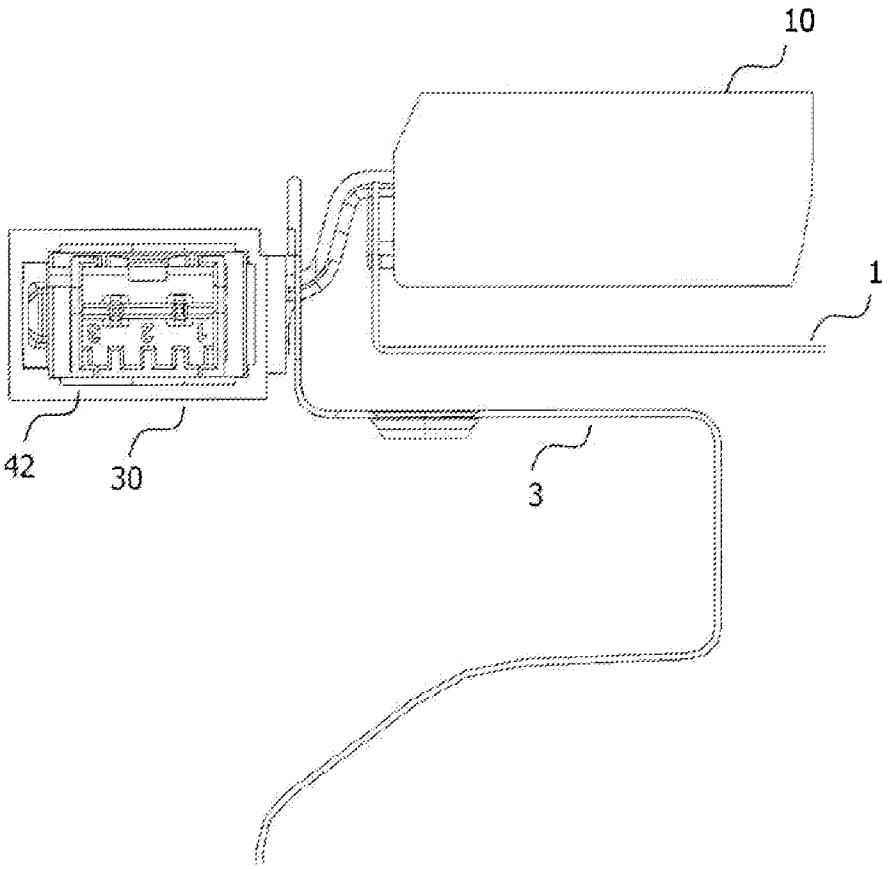
FIG. 1*a* is a diagrammatic representation of a side view of a door lock according to a first embodiment of the present invention in the fitted state.

In FIG. 1*a*, it is diagrammatically indicated that a closing unit 10 is mounted as a first component of the door lock on an appliance housing 1 of a dishwashing machine. It is also indicated only diagrammatically in FIG. 1 that the closing unit 10 is mounted on the appliance housing 1 above the container for receiving the material that is to be cleaned. As a second component, a switchgear unit 30 of the door lock is mounted on a door 3 of the dishwashing machine, as is likewise diagrammatically indicated in FIG. 1*a*. In the closed state of the door lock shown in FIG. 1*a* the two components, the closing unit 10 and the switchgear unit 30, lie opposite one another and may therefore enter into a releasable connection with one another. The door lock is not limited to the previously described arrangement, in which the closing unit 10 is disposed in the appliance housing 1 and the switchgear unit 30 is disposed on the door 3. It is equally possible for the closing unit 10 to be disposed on the door 3 and the switchgear unit 30 to be disposed in the appliance housing 1.

Figure 1B:
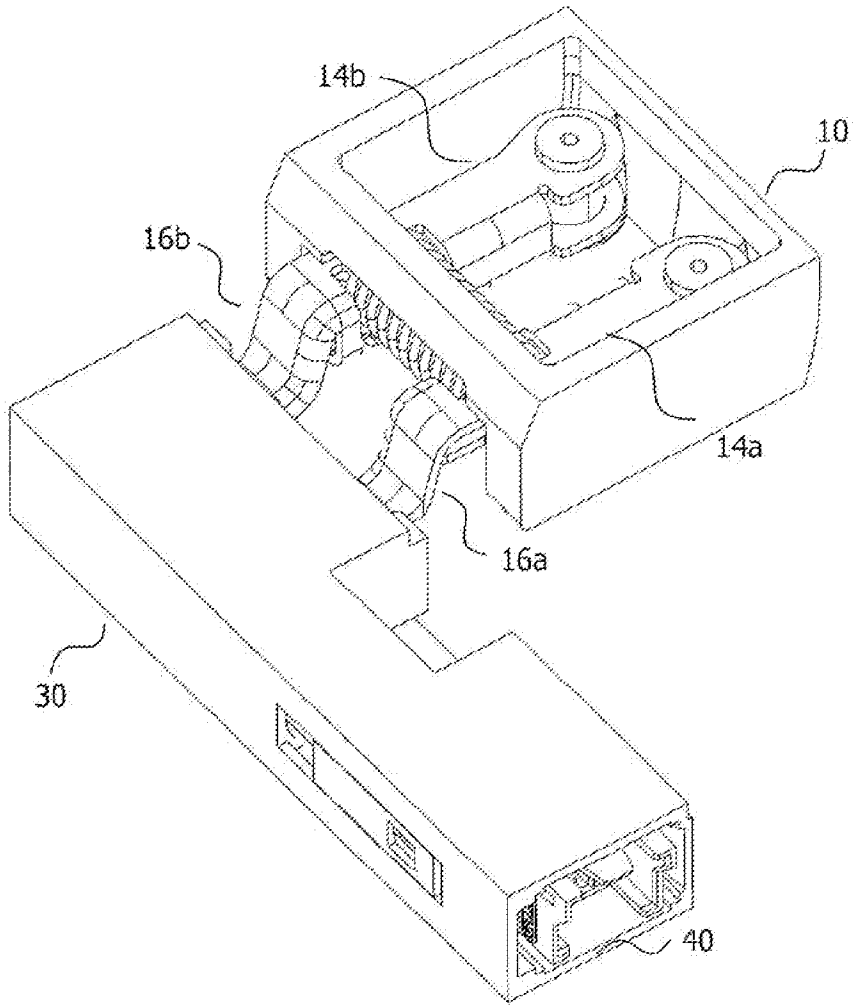
FIG. 1*b* is a diagrammatic representation of a lateral plan view of the door lock according to the first embodiment according to FIG. 1*a*.

FIG. 1*b* shows the door lock according to the first embodiment in a state, in which it is not fitted in the dishwashing machine but is closed.

Figure 2A:
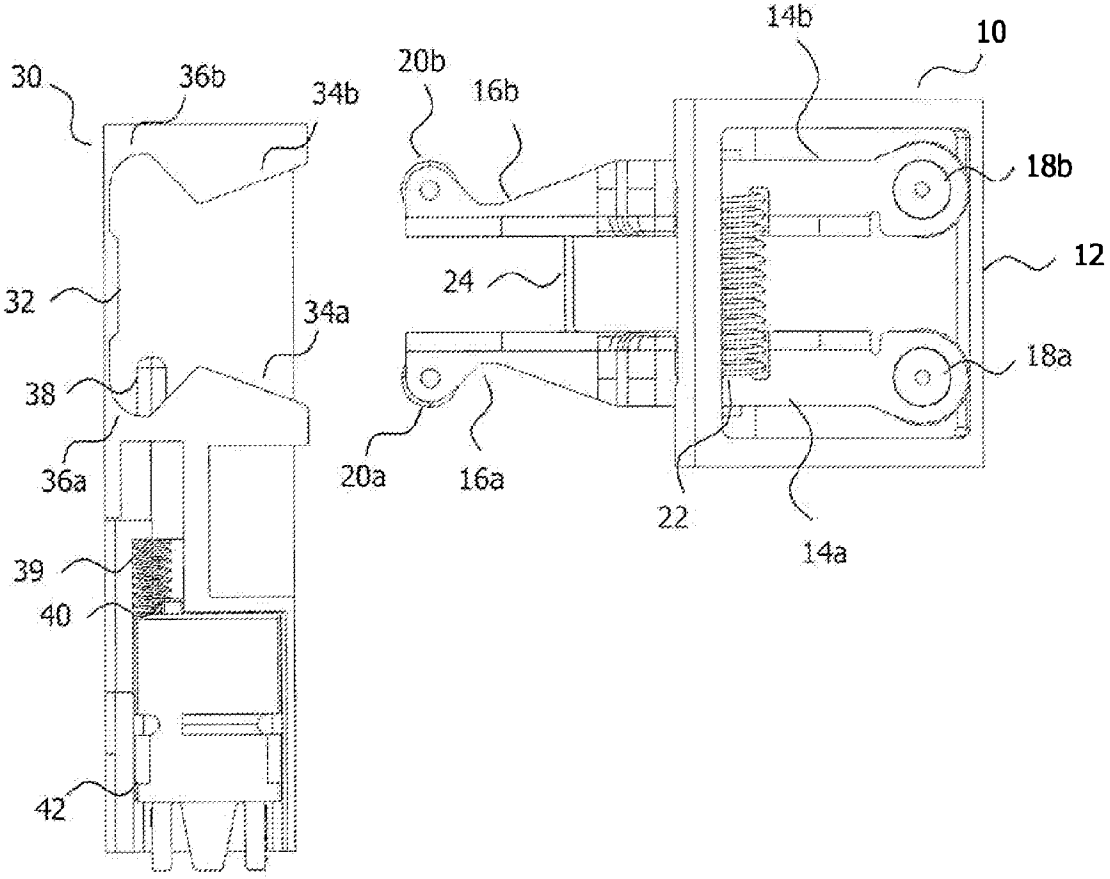
FIG. 2*a* is a diagrammatic representation of a plan view of the door lock according to the first embodiment in an open state.
Figure 2B:
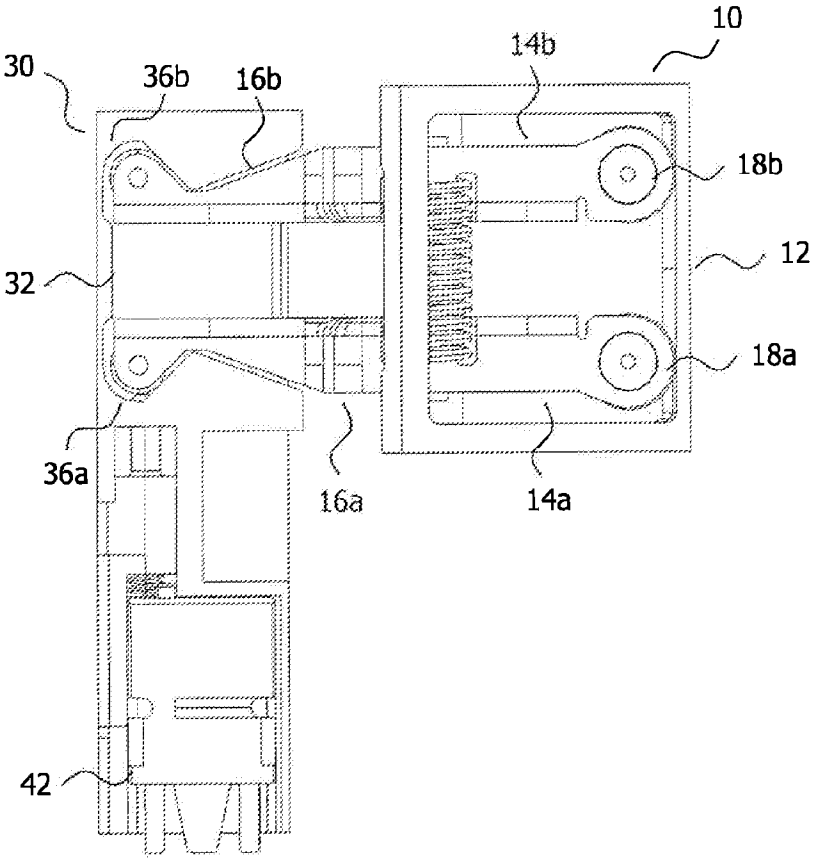
FIG. 2*b* is a diagrammatic representation of a plan view of the door lock according to the first embodiment in a closed state.

FIGS. 2*a* and 2*b* show further details of the door lock according to the first embodiment of the present invention. The closing unit 10 of the door lock comprises a housing 12, to which two closing arms 14*a*, 14*b* are connected. The closing arms 14*a*, 14*b* are mounted in each case via a bearing 18*a*, 18*b* in the housing 12. Each of the closing arms 14*a*, 14*b* is rotatable about its associated bearing 18*a*, 18*b*. In each case free arm portions 16*a*, 16*b* of the closing arms 14*a*, 14*b* project from the housing 12. Disposed between the two closing arms 14*a*, 14*b* is a compression spring 22, which by means of its spring action presses the two closing arms 14*a*, 14*b* apart from one another. As is represented by way of example in FIGS. 2*a* and 2*b*, the compression spring 22 is fitted in between the two closing arms 14*a*, 14*b*. The door lock according to the first embodiment is however not limited thereto, i.e. the compression spring 22 may be disposed in some other way than by fitting in between the closing arms 14*a*, 14*b*. The normal mutual spacing of the two closing arms 14*a*, 14*b* is determined by means of a bridge arrangement 24 that is connected to the two closing arms 14*a*, 14*b*. As the bridge arrangement 24 is permanently connected to the two closing arms 14*a*, 14*b*, the closing arms 14*a*, 14*b* in their normal position are remote from one another by a normal spacing, which is determined by the width of the bridge arrangement 24 and corresponds substantially to this width.

Figure 3:
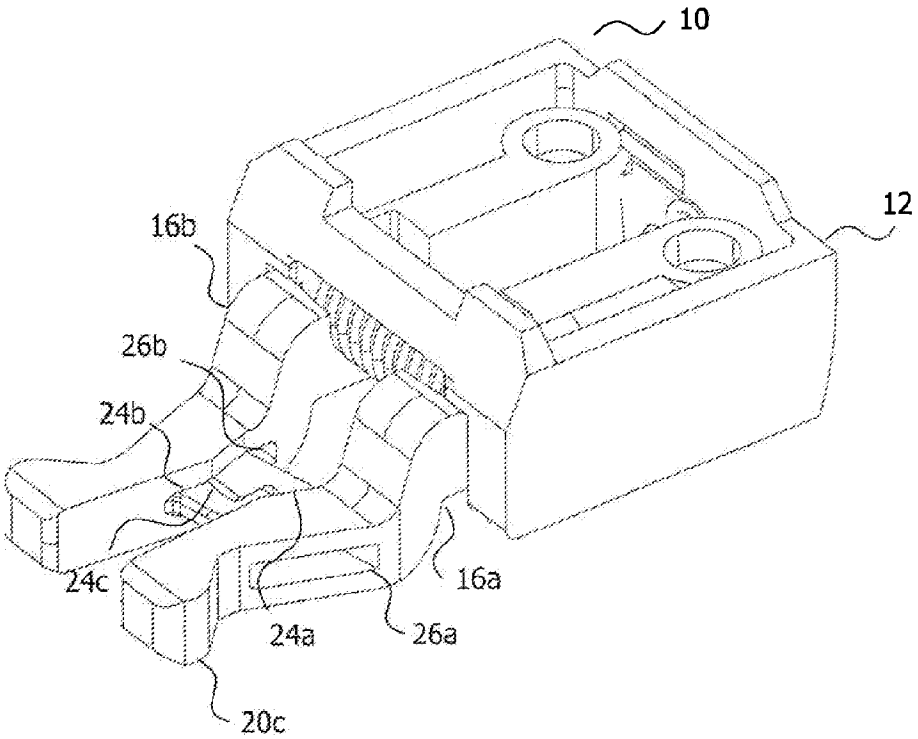
FIG. 3 is a diagrammatic representation of a lateral plan view of a component of a door lock according to a second embodiment of the present invention.

In FIGS. 2*a* and 2*b* the bridge arrangement 24 is only diagrammatically indicated. Details of the bridge arrangement may be seen in FIG. 3. FIG. 3 in fact shows a door lock according to a second embodiment of the present invention. The first and the second embodiment do not however differ in the configuration of the bridge arrangement 24. As may be seen in FIG. 3, the bridge arrangement 24 is of a two-part construction. A first part 24*a* of the bridge arrangement 24 is in this case permanently connected to the first closing arm 14*a* (more precisely, to the free arm portion 16*a* of the first closing arm 14*a*). The second part 24*b* on the other hand is permanently connected to the second closing arm 14*b* (more precisely, to the free arm portion 16*b* of the second closing arm 14*b*). The two bridge parts 24*a*, 24*b* are in mutual engagement. This engagement is achieved in that both bridge parts 24*a*, 24*b* extend at least almost parallel to one another between the closing arms 14*a*, 14*b* and transversely of their direction of extent have projections on their respective end. Such a projection 24*c* is shown in FIG. 3 for the bridge part 24*a* that is connected to the first closing arm 14*a*. However the bridge part 24*b* also has such a projection. The free arm portions 16*a*, 16*b* are pressed apart from one another by the action of the compression spring 22. The free arm portions 16*a*, 16*b* may however not be further remote from one another than is dictated by the width of the bridge arrangement 24. This is because the projection 24*c* of the first bridge part 24*a* engages in such a way into the second bridge part 24*b* that the projection 24*c* presses against a side of the second bridge part 24*b* counter to the action of the compression spring 22 and hence braces the free arm portion 16*a* against the second free arm portion 16*b*. In an identical manner the non-illustrated projection of the second bridge part 24*b* engages into the first bridge part 24*a*. As a result of the mutual engagement of the bridge parts 24*a*, 24*b* into one another, the free arm portions are quasi fastened to one another and cannot be pressed further apart from one another by the action of the compression spring 22 than their normal spacing.

The free arm portions 16*a*, 16*b* each have a recess 26*a*, 26*b*, into which the bridge parts 24*a*, 24*b* may engage when the arm portions 16*a*, 16*b* are pressed together counter to the action of the compression spring 22. More precisely, as the arm portions 16*a*, 16*b* are pressed together, the bridge part 24*a* connected to the first free arm portion 16*a* travels into the recess 26*b* formed in the second free arm portion 16*b*. Similarly, as the arm portions 16*a*, 16*b* are pressed together, the second bridge part 24*b* connected to the second free arm portion 16*b* travels into the recess 26*a* formed in the first free arm portion 16*a*. In FIG. 3 the recess 26*a*, 26*b* are shown as openings that fully penetrate the associated arm portions 16*a*, 16*b*. However none of the embodiments shown in the figures is limited thereto. It is equally possible not to configure the recesses 26*a*, 26*b* as complete openings that are open towards both sides of the corresponding arm portion but to provide an opening only towards the inner sides (the sides oriented counter to the action of the compression spring 22) of the respective arm portion, so that the openings of the recesses 26*a*, 26*b* lie opposite one another. The outer sides (the sides oriented in the direction of the action of the compression spring 22) may in this case be closed. This alternative configuration also enables an at least partial introduction of the bridge parts 24*a*, 24*b* into the opposite recess 26*a*, 26*b*.

The door lock according to the first embodiment will now be described again with reference to FIGS. 2*a* and 2*b*. According to the embodiment shown in FIG. 2*a* each of the closing arms 14*a*, 14*b* may be deflected inwards independently of the other closing arm 14*a*, 14*b*. As a result of the inward deflection the mutual spacing of the closing arms 14*a*, 14*b* is reduced.

The outer sides of the closing arms 14*a*, 14*b* in their normal position do not rest directly against the inner wall of the housing 12. This is shown most clearly in FIGS. 7*a* and 7*b* but applies similarly to the first embodiment according to FIGS. 1*a* to 2*b* and the second embodiment according to FIG. 3. Between the inner wall of the housing 12 and the outer side of the second closing arm 14*b* there is a gap 28*b* (see FIG. 7*b*). A similarly designed gap (not shown) is situated in a corresponding manner between the first closing arm 14*a* and the opposite inner wall of the housing 12. Because of the gap at both sides the closing arms 14*a*, 14*b* connected by the bridge arrangement 24 may be moved jointly. This joint movement may be effected both in the direction of the gap 28*b* and in the direction of the non-illustrated gap, wherein both closing arms 14*a*, 14*b* maintain their constant normal mutual spacing.

This minimal joint movement of the closing arms 14*a*, 14*b* may be referred to as a motional clearance in relation to the housing 12.

Finally, as may be seen in FIG. 2*a*, the two closing arms 14*a*, 14*b* each have a roller 20*a*, 20*b* on their free end (the end, at which they are not mounted rotatably about the bearing 18*a*, 18*b*).

As may be seen in FIGS. 2*a* and 2*b*, the switchgear unit 30 has a closing mouth 32 that is adapted to the free arm portions 16*a*, 16*b* of the closing arms 14*a*, 14*b*. The closing mouth 32 comprises two deflection surfaces 34*a*, 34*b* that are adapted to the free arm portions 16*a*, 16*b*. Situated in an end portion of the closing mouth are two cavities 36*a*, 36*b* that correspond to the shape of the free ends of the arm portions 16*a*, 16*b* in such a way that the free ends carrying the rollers 20*a*, 20*b* may be received in the cavities 36*a*, 36*b*.

When the door 3 is moved relative to the appliance housing 1 and closed, the free arm portions 16*a*, 16*b* engage into the closing mouth 32. During closing of the door 3 the switchgear unit 30 and the closing unit 10 move relative to one another towards one another. Close to the end of the closing operation the arm portions 16*a*, 16*b* engage into the closing mouth 32 and slide with their rollers 20*a*, 20*b* along the associated deflection surfaces 34*a*, 34*b*. As may be seen in FIG. 2*a*, the deflection surfaces run in a funnel-like manner towards one another and therefore narrow the opening of the closing mouth 32. In accordance with the narrowing the free arm portions 16*a*, 16*b* are increasingly pressed together counter to the action of the compression spring 22 until the point of maximum narrowing in the closing mouth 32 is reached. When the free arm portions 16*a* 16*b* during further engagement move beyond the corresponding point of maximum narrowing (and hence their maximum deflection relative to one another counter to the spring action), the closing mouth 32 widens in the end portion of the closing mouth 32. Since upon entry into the end portion a force is no longer exerted on the arm portions 16*a*, 16*b* by the deflection surfaces 34*a*, 34*b*, the free arm portions 16*a*, 16*b* are deflected in each case in the direction of the spring action back towards their normal position. Depending on the width and shape of the end portion, the free arm portions 16*a*, 16*b* of the closing arms 14*a*, 14*b* may in this case return to their normal position, but may alternatively move into an intermediate position, in which their mutual spacing is smaller than the normal spacing.

During closing of the door 3 the arm portions 16*a*, 16*b* engage further into the end portion until the end position is reached. In this end position the free ends of the arm portions 16*a*, 16*b* that carry the rollers 20*a*, 20*b* are situated in the cavities 36*a*, 36*b* and the closing unit 10 and the switchgear unit 30 enter into a frictional connection with one another. The door 3 may be opened again counter to the force exerted by this frictional connection if the externally exerted force exceeds the opposing force produced by the frictional connection. The first embodiment is adapted in such a way that the force required for opening is ca. 50 N.

When the door is opened, the rollers 20*a*, 20*b* of the arm portions 16*a*, 16*b* slide along the rising inner surfaces of the cavities 36*a*, 36*b*. The arm portions 16*a*, 16*b* are therefore pressed together until they reach the point of maximum narrowing. When the arm portions 16*a*, 16*b* are moved further relative to the closing mouth 32 counter to the direction of engagement when closing the door, the rollers 20*a*, 20*b* slide backwards along the deflection surfaces 34*a*, 34*b*, and the arm portions 16*a*, 16*b* are pressed apart again by the action of the compression spring 22. After the complete release of the switchgear unit 30 from the closing unit 10, the arm portions 16*a*, 16*b* return to their normal position.

FIG. 2*b* shows the closed (end) state with fully engaged arm portions 16*a*, 16*b*. In this representation according to FIG. 2*b* the free arm portions 16*a*, 16*b* have for example returned to their normal position, in which they are held by means of the bridge arrangement 24. This is however to be understood as merely by way of example and the end portion, into which the arm portions 16*a*, 16*b* have engaged, may alternatively be formed with a smaller width than the width of the bridge arrangement 24, so that the arm portions 16*a*, 16*b* are held in the closing mouth 32 with a smaller mutual spacing than the normal spacing. In the state shown in FIG. 2*b* the switchgear unit 30 and the closing unit 10 are connected releasably to one another in that they enter into an at least partial frictional connection with one another.

As is evident from FIG. 2*a*, the switchgear unit 30 further comprises a contacting element, which in FIG. 2*a* is configured by way of example as contacting pin 38. The switchgear unit 30 further comprises a switch configured by way of example as microswitch 40, which acts upon a connection configured by way of example as Rast 2.5 connector.

As is evident from FIGS. 2*a* and 2*b*, the first arm portion 16*a* presses the contacting pin 38 downwards transversely of the direction of engagement of the arm portions 16*a*, 16*b*. The contacting pin 38 therefore activates the microswitch 40. As a result of the activation of the microswitch 40 it is detected that the door 3 of the dishwashing machine has been fully closed. As a result of the activation of the microswitch 40 the electric circuit in the dishwashing machine is then closed and the washing operation may be carried out. This is not possible if the door is not fully closed. It is alternatively conceivable that the microswitch 40 is activated in the open state of the door and the deactivation of the microswitch 40 that is triggered by displacement of the contacting pin 38 is detected and indicates that the door 3 has been closed.

FIG. 3 shows the closing unit 10 of the door lock according to a second embodiment of the present invention. In this second embodiment the switchgear unit (not shown) corresponds to the switchgear unit 30 of the first embodiment shown in FIGS. 1*a* to 2*b*. The closing unit 10 according to the second embodiment differs from the closing unit 10 of the first embodiment only in that, not rollers 20*a*, 20*b*, but sliding surfaces 20*c* are formed on the free ends of the arm portions 16*a*, 16*b*. As a result, as the arm portions 16*a*, 16*b* engage into the closing mouth 32, the sliding friction between the arm portions 16*a*, 16*b* and the deflection surfaces 34*a*, 34*b* and hence the expenditure of force required for the introduction process is increased (compared to the first embodiment). Accordingly, in the closed position also the sliding friction in the second embodiment is increased, with the result that a higher force has to be expended to release the connection between the switchgear unit 30 and the closing unit 10.

Figure 4A:
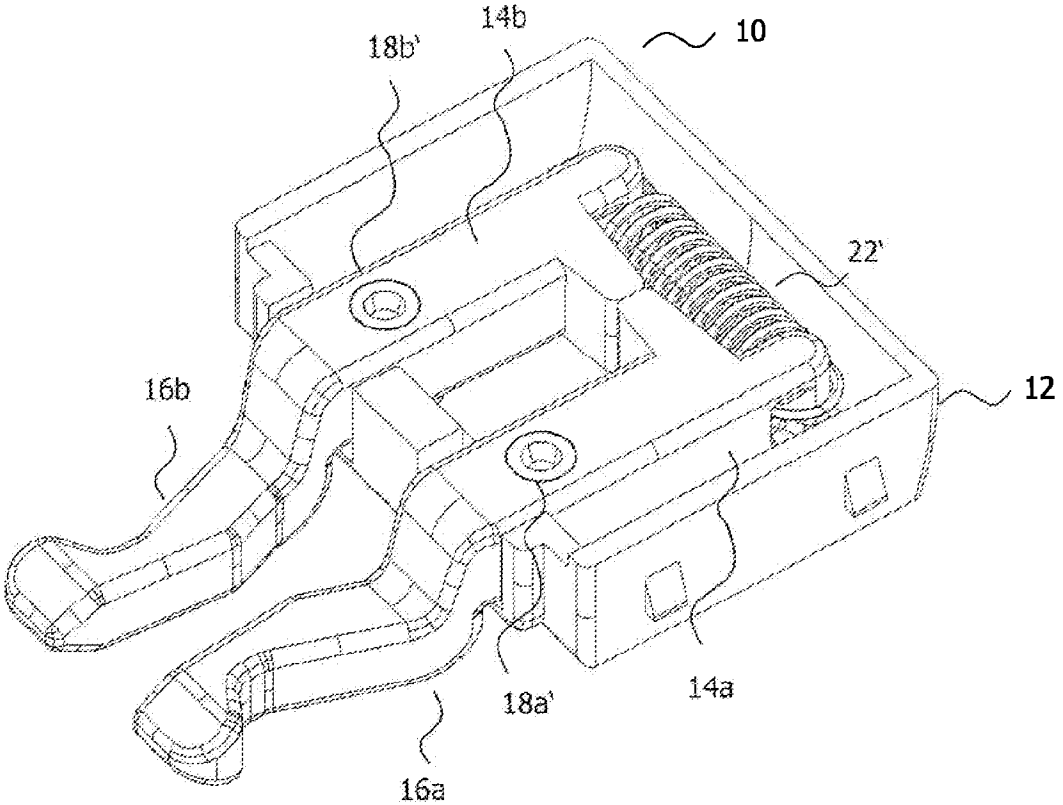
FIG. 4*a* is a diagrammatic representation of a lateral plan view of a component of a door lock according to a third embodiment of the present invention.

According to a third embodiment the closing unit 10 of the door lock that is shown in FIG. 4*a* differs from the closing unit 10 of the second embodiment in that instead of the compression spring 22 a tension spring 22' is disposed between the closing arms 14*a*, 14*b* and the bearings 18*a*', 18*b*' of the closing arms 14*a*, 14*b* are disposed at other points in longitudinal direction of the closing arms 14*a*, 14*b* than the bearings 18*a*, 18*b*. More precisely, the bearings 18*a*', 18*b*' are no longer disposed on the ends of the closing arms 14*a*, 14*b* but are situated in longitudinal direction of the closing arms 14*a*, 14*b* approximately where in the second embodiment the compression spring 22 was disposed. Naturally the positions of the bearings 18*a*', 18*b*' in longitudinal direction of the closing arms 14*a*, 14*b* is to be understood as merely by way of example, i.e. the bearings 18*a*', 18*b*' may alternatively be situated at other suitable positions. The tension spring 22' is situated between the ends of the closing arms 14*a*, 14*b* that are disposed in the housing 12. Furthermore, as is evident from FIG. 4*b*, the closing unit 10 according to the third embodiment has 2 blocking elements configured as blocking fingers 38*a*, 38*b*, which are supported against one another. Consequently the closing arms 14*a*, 14*b* are also supported against one another.

Figure 4B:
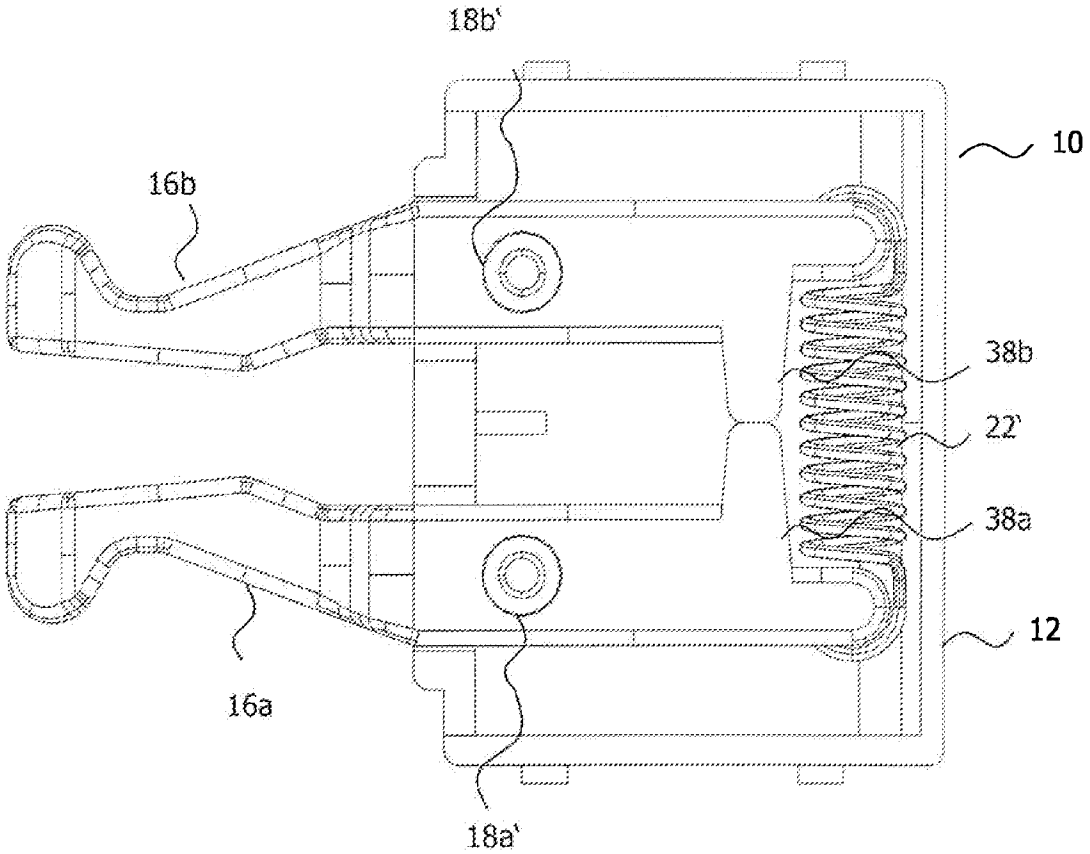
FIG. 4*b* is a diagrammatic representation of a plan view of the component of the door lock according to the third embodiment according to FIG. 4*a*.

The closing unit 10 according to FIGS. 4*a* and 4*b* may be used with the switchgear unit 30 of FIGS. 2*a* and 2*b*. When the door 3 is then moved relative to the appliance housing 1 and closed, the free arm portions 16*a*, 16*b* of the closing unit 10 of FIGS. 4*a* and 4*b* engage into the closing mouth 32 of the switchgear unit 30 of FIGS. 2*a* and 2*b*. During closing of the door 3 the switchgear unit 30 and the closing unit 10 move relative to one another towards one another. Close to the end of the closing operation the arm portions 16*a*, 16*b* engage into the closing mouth 32 and slide with their free ends of the arm portions 16*a*, 16*b* along the associated deflection surfaces 34*a*, 34*b*. Since, as is evident from FIG. 2*a*, the deflection surfaces 34*a*, 34*b* run in a funnel-like manner towards one another and hence narrow the opening of the closing mouth 32, the free arm portions 16*a*, 16*b* are in accordance with the narrowing increasingly pressed together counter to the action of the tension spring 22' until the point of maximum narrowing in the closing mouth 32 is reached. When the free arm portions 16*a*, 16*b* upon further engagement move beyond the corresponding point of maximum narrowing, the closing mouth 32 widens in the end portion of the closing mouth 32. Since upon entry into the end portion a force is no longer exerted on the arm portions 16*a*, 16*b* by the deflection surfaces 34*a*, 34*b*, the tensile force of the tension spring 22' results in the free arm portions 16*a*, 16*b* being deflected in each case back in the direction of their normal position. Depending on the width and shape of the end portion, the free arm portions 16*a*, 16*b* of the closing arms 14*a*, 14*b* may in this case return to their normal position but may alternatively move into an intermediate position, in which their mutual spacing is smaller than the normal spacing. Thus, the free arm portions 16*a*, 16*b* are each deflected back towards their normal position counter to the direction of the spring action.

During further closing of the door 3 the arm portions 16*a*, 16*b* engage further into the end portion until the end position is reached. In this end position the free ends of the arm portions 16*a*, 16*b* are situated in the cavities 36*a*, 36*b* and the closing unit 10 and the switchgear unit 30 enter into a frictional connection with one another. The door 3 may be reopened counter to the force exerted by this frictional connection if the externally exerted force exceeds the opposing force produced by the frictional connection. The third embodiment also is adapted in such a way that the force required for opening is ca. 50 Newtons.

Figure 5A:
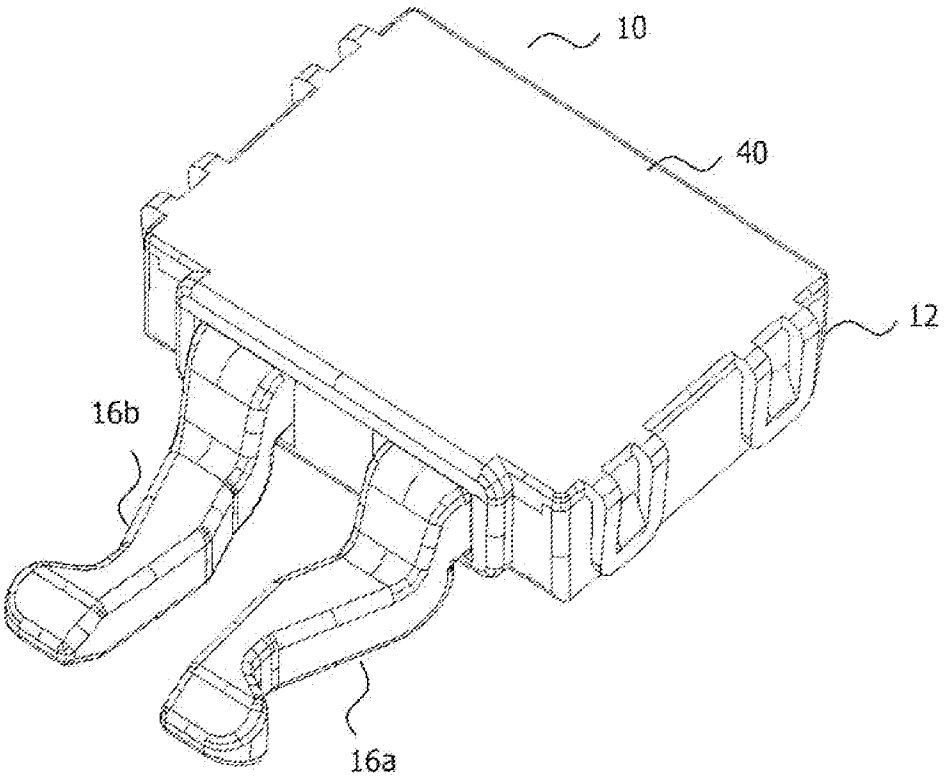
FIG. 5*a* is a diagrammatic representation of a lateral plan view of a component of a door lock according to a fourth embodiment of the present invention.
Figure 5B:
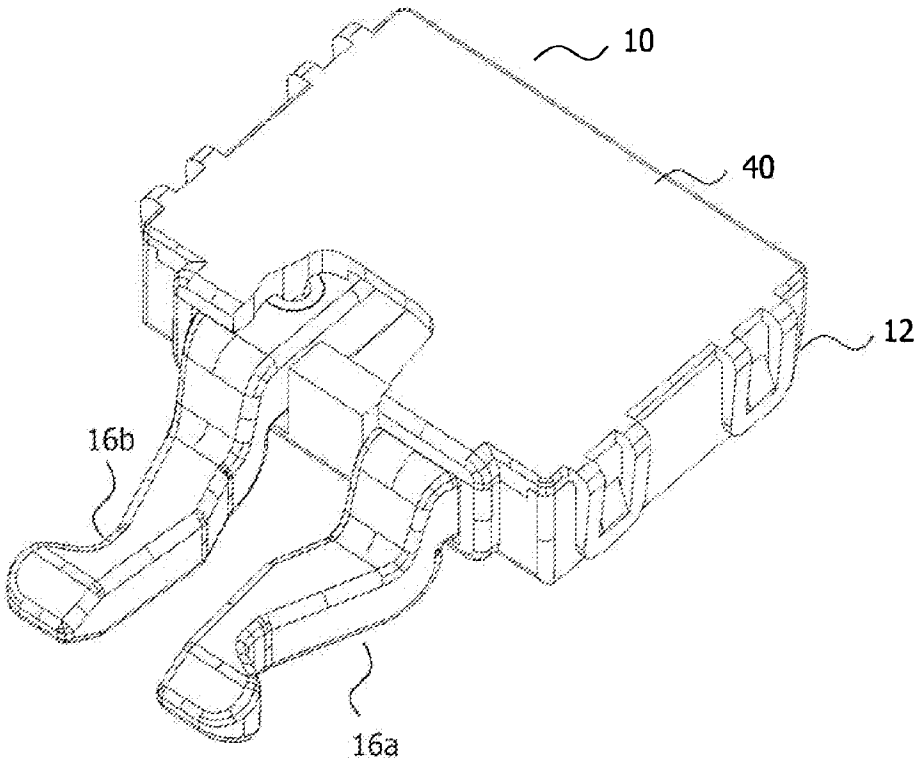
FIG. 5*b* is a diagrammatic representation of a lateral plan view of the component of the door lock according to the fourth embodiment according to FIG. 5*a*.

FIGS. 5*a* and 5*b* show the closing unit 10 according to a fourth embodiment. This fourth embodiment corresponds to the third embodiment of FIGS. 4*a* and 4*b* and moreover comprises a cover 40. As may be seen in FIG. 5*b*, in each case a projection associated with the bearings 18*a*', 18*b*' and formed on the cover 10 projects into the bearing points. This results in an increased and improved fixing of the bearing points.

Figure 6:
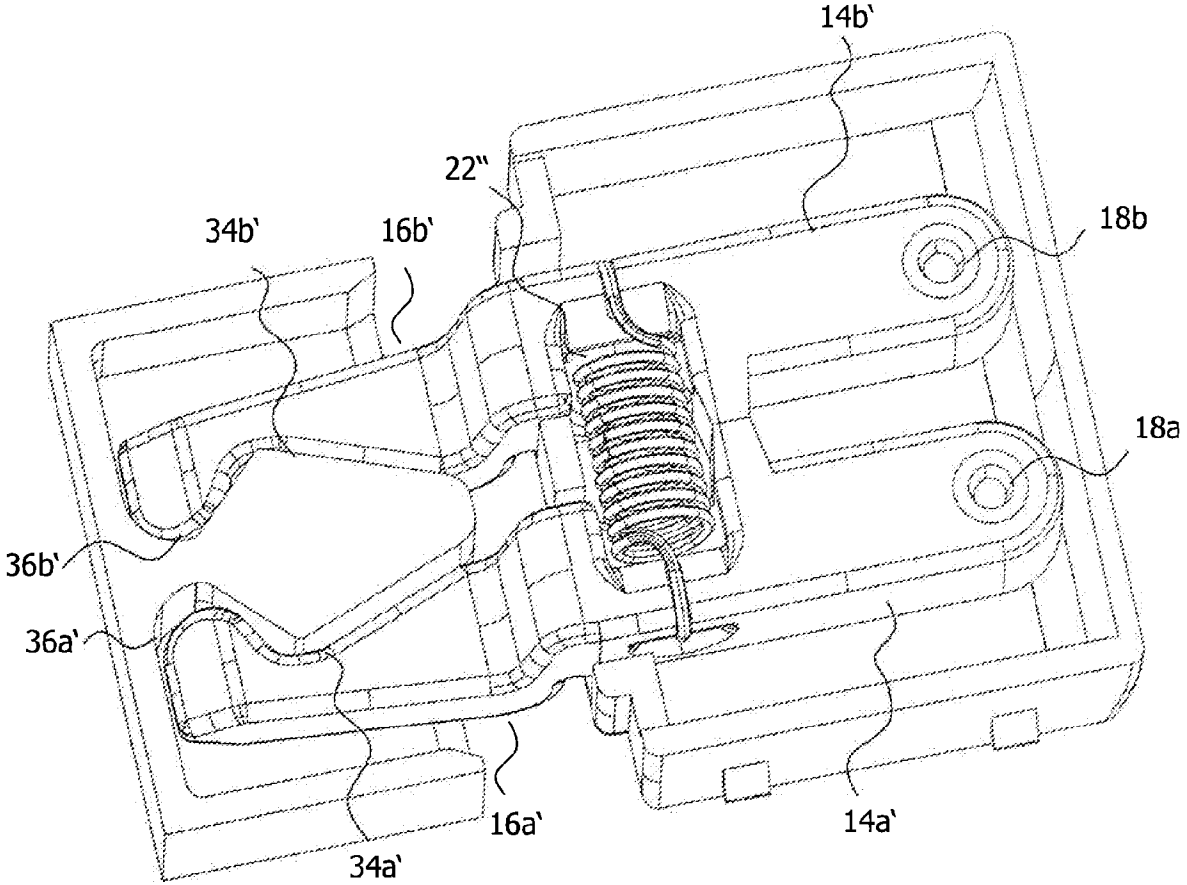
FIG. 6 is a diagrammatic representation of a lateral plan view of a door lock according to a fifth embodiment of the present invention.

FIG. 6 shows a door lock according to a fifth embodiment. In the fifth embodiment the functional principle described with reference to FIGS. 1 to 5*b* is reversed. The functional principle outlined with reference to the previously described embodiments is based on the fact that initially the free arm portions 16*a*, 16*b* of the closing arms 14*a*, 14*b* are held mutually spaced apart in a relative normal position by the transversely effective action of the spring 22, 22'. During engagement of the free arm portions 16*a*, 16*b* into the closing mouth 32 the free arm portions 16*a*, 16*b* are pressed together and finally pressed apart again in the direction of the normal position. According to the fifth embodiment of FIG. 6 this functional principle is reversed in that the free arm portions 16*a*', 16*b*' are held in a normal position by means of a tension spring 22". In the normal position shown by way of example in FIG. 6, the free arm portions 16*a*', 16*b*' are spaced apart from another. It is however also conceivable that the free arm portions 16*a*, 16*b* (in the normal position) are fully pressed together. During engagement into the closing mouth 32 the free arm portions 16*a*', 16*b*' interact in such a way with deflection surfaces 34*a*', 34*b*' disposed in a cone-like manner that the free arm portions 16*a*', 16*b*' are pressed apart from one another counter to the action of the tension spring 22". After further engagement into the closing mouth 32 the free arm portions 16*a*', 16*b*' are pressed together again by the action of the tension spring 22" and engage into cavities 36*a*', 36*b*' in order to form a keyed connection. As is evident from FIG. 6, the deflection surfaces 34*a*', 34*b*' together with the cavities 36*a*', 36*b*' form a mushroom-like formation. The engagements of the free ends of the arm portions 16*a*', 16*b*' are directed inwards and adapted to the cavities 36*a*', 36*b*'.

Figure 7A:
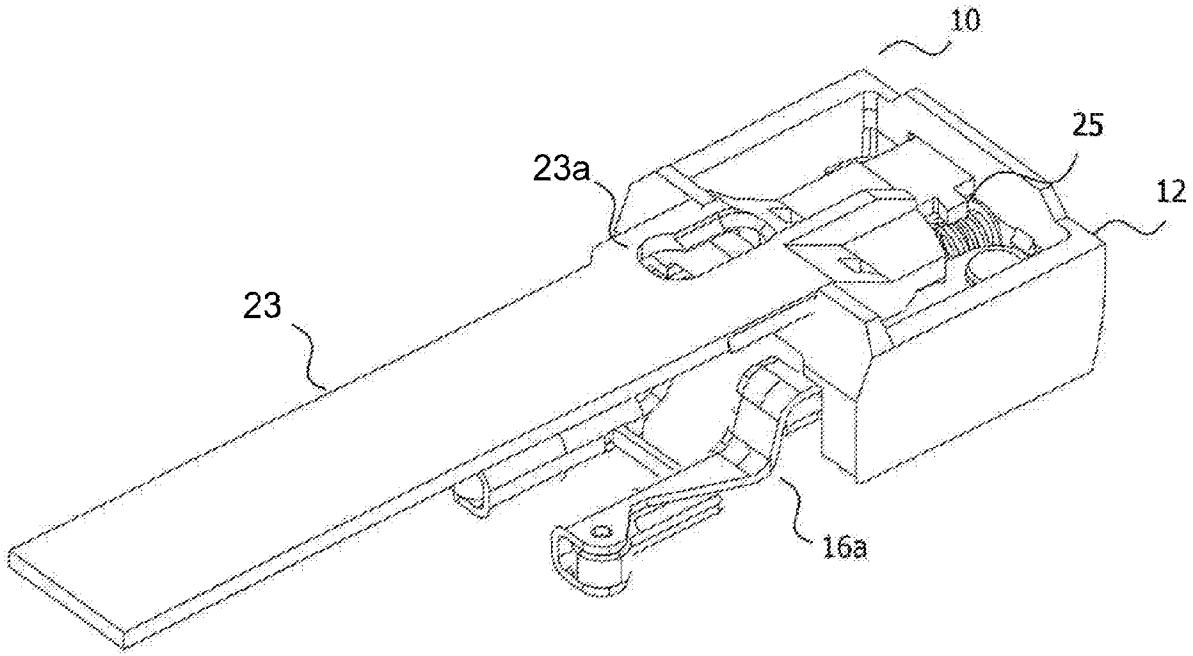
FIG. 7*a* is a diagrammatic representation of a lateral plan view of a component of a door lock according to a sixth embodiment of the present invention.
Figure 7B:
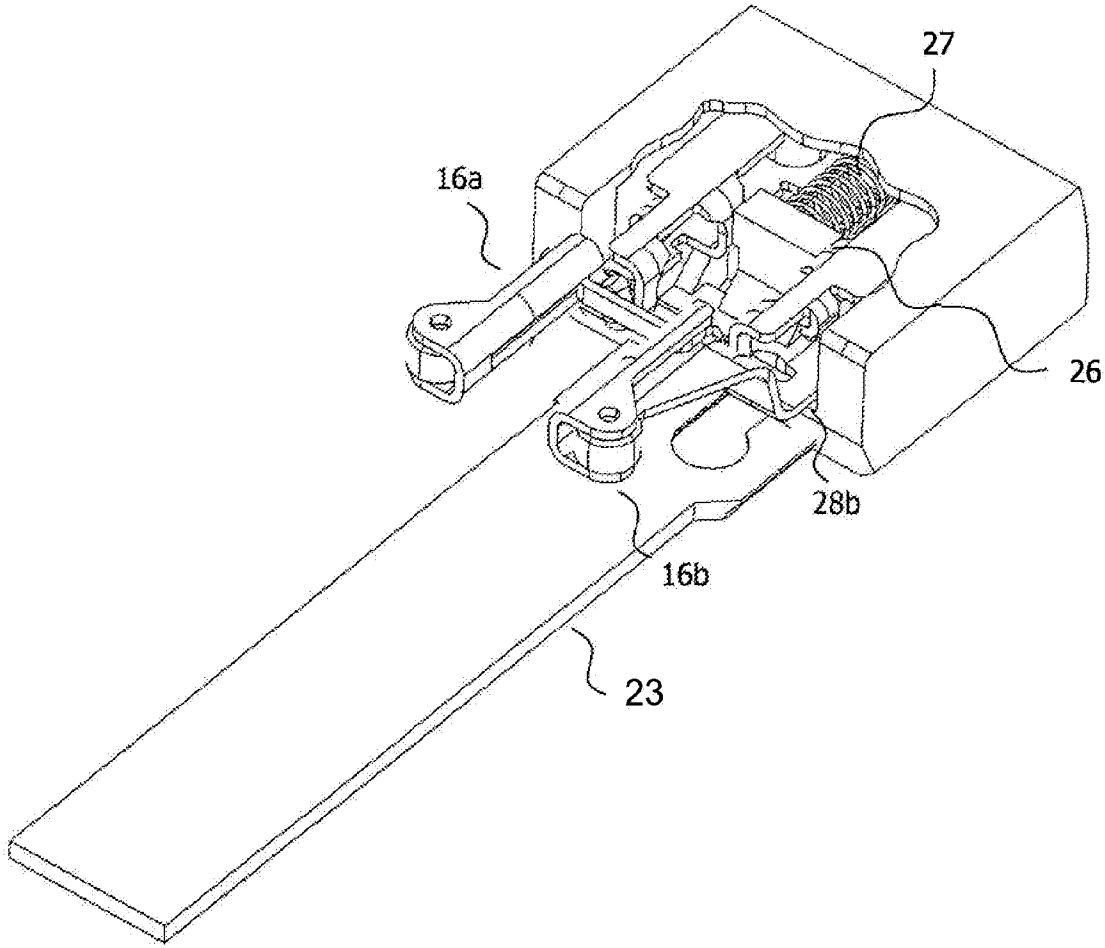
FIG. 7*b* is a further diagrammatic representation of the component of the door lock according to the sixth embodiment of the present invention of FIG. 7*a* in a turned-over position.

According to a sixth embodiment the closing unit 10 of the door lock shown in FIGS. 7*a* and 7*b* differs from the closing unit 10 of the first embodiment in that there is disposed between the closing arms 14*a*, 14*b* a blocking element 26, which may be displaced by means of a manual actuation element 23. The blocking element 26 in its first position shown in FIG. 7*b* is positioned in such a way that it extensively enables the relative deflection of the arm portions 16*a*, 16*b* of the closing arms 14*a*, 14*b*, i.e. the free arm portions may be deflected extensively uninfluenced by the blocking element 26. The blocking element 26 is held in the first position counter to the action of a second compression spring 27 acting in the direction of the direction of extent of the closing arms 14*a*, 14*b* in that a lug 25 of the manual actuation element 23 is supported against the outer wall of the housing 12 counter to the action of the second compression spring 27. By actuating the manual actuation element 23 in such a way that the lug 25 is detached from the outer wall of the housing 12, the manual actuation element 23 and the blocking element 26 connected thereto are pressed by the action of the second compression spring 27 in the direction of the direction of engagement of the free arm portions 16*a*, 16*b* and the blocking element therefore moves into a second position. The movement of the manual actuation element is guided with the aid of a guide 23*a*.

In the second position the relative deflectability of the arm portions 16*a*, 16*b* is almost blocked. This is achieved by the fact that the blocking element 26 is situated closer to the free ends of the arm portions 16*a*, 16*b* and hence shortens the active lever arm of the arm portions 16*a*, 16*b*. Given completely rigid closing arms 14*a*, 14*b*, a movement of the arm portions 16*a*, 16*b* may then be completely prevented. If the closing arms 14*a*, 14*b* are not completely rigid but flexible, a slight deflection of the arm portions 16*a*, 16*b* may occur due to the inherent flexibility.

When the blocking element is in its second position (blocking position), both the engaging of the arm portions 16*a*, 16*b* of the closing arms 14*a*, 14*b* into the closing mouth 32 and the release thereof from the closing mouth 32 are made more difficult.

With the aid of the blocking element 26 the following functionality may be achieved. Firstly, in the open state of the door 3 the blocking element 26 is in its first position, in which the deflection of the free arm portions 16*a*, 16*b* of the closing arms is facilitated. In this position, during closing of the door 3 the arm portions 16*a*, 16*b* of the closing arms 14*a*, 14*b* in the course of engaging into the closing mouth 32 are first pressed together and finally pressed apart from one another again in the direction of the action of the compression spring 22 in order to enter into the connection with the switchgear unit 30. After closing of the door 3 the manual actuation element 23 projects out from the door 3 and is freely accessible from outside by a user and may be actuated by the user. By actuating the manual actuation element 23 the blocking element 26 is displaced by the action of the second compression spring 27 in the direction of the free ends of the arm portions 16*a*, 16*b* and hence (by shortening the active lever arm of the freely deflectable arm portions 16*a*, 16*b*) blocks the movement of the arm portions 16*a*, 16*b* towards one another. As a result, the release of the arm portions from the cavities 36*a*, 36*b* and hence opening of the door 3 are made more difficult. The third embodiment is adapted in such a way that a force of ca. 100 N is now required for opening the door 3 in the activated state of the blocking element 26 (i.e. the blocking element is situated in its second position, the blocking position). Such a force may namely be expended usually by an adult, but not by a child. The increased expenditure of force is based on the fact that the deflectability of the free arm portions in this state is based almost exclusively (if provided) on the inherent flexibility of the closing arms 14*a*, 14*b*. The increased expenditure of force prevents a child from accessing the washing compartment during a washing operation. However, an adult also senses that a higher expenditure of force is required and may deduce from this that the blocking element 26 is in its blocking state. To release this blocking the adult may simply move the manual actuation element 23 counter to the action of the second spring 27 and hence release the free arm portions 16*a*, 16*b*.

Figure 8B:
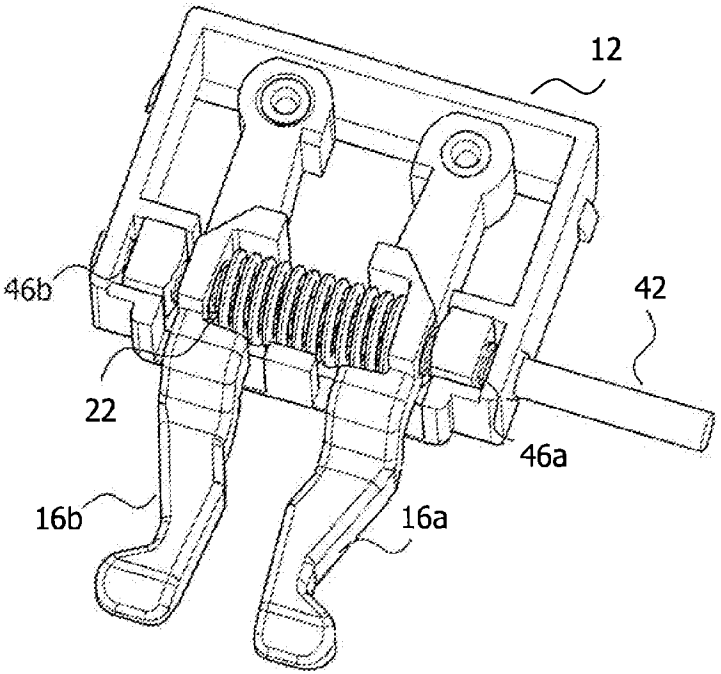
FIG. 8*b* is a diagrammatic representation of a lateral plan view of the component of the door lock according to the seventh embodiment according to FIG. 8*a*.
Figure 8A:
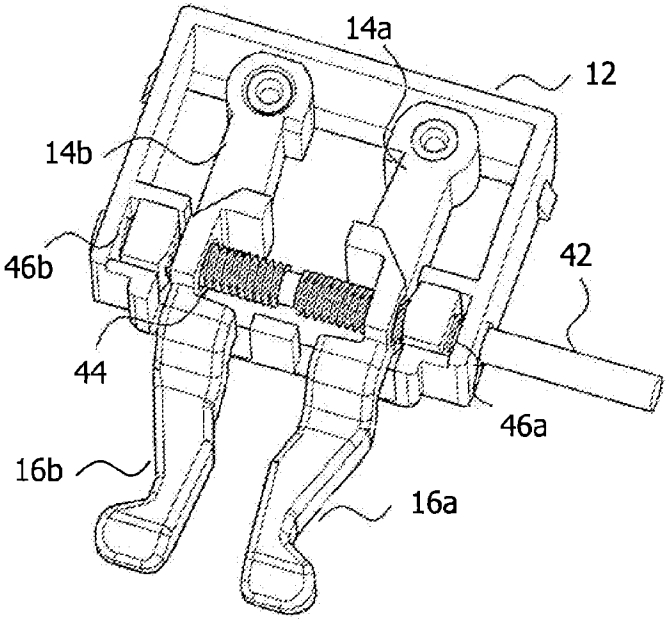
FIG. 8*a* is a diagrammatic representation of a lateral plan view of a component of a door lock according to a seventh embodiment of the present invention.
Figure 8C:
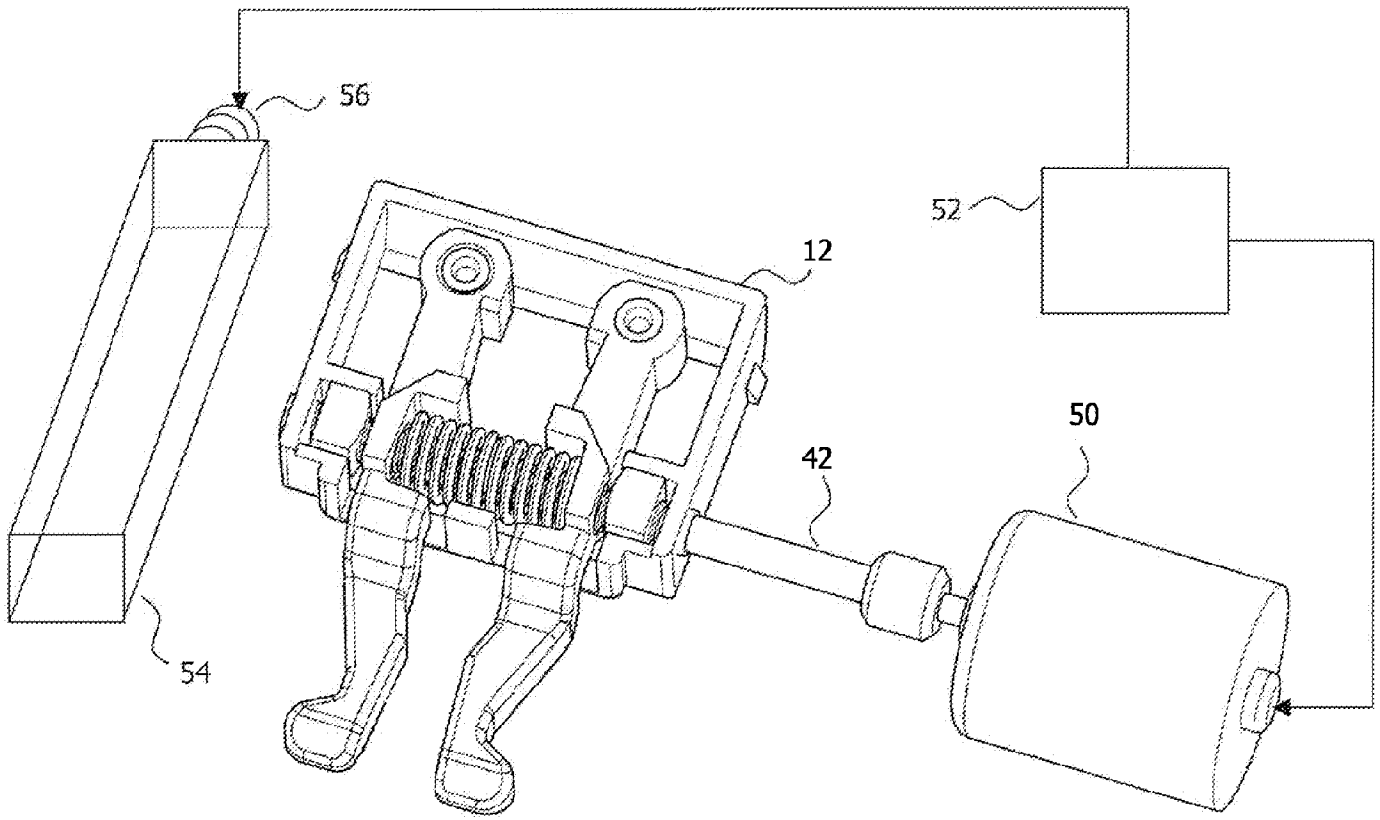
FIG. 8*c* is a diagrammatic representation of a lateral plan view of the component of the door lock according to the seventh embodiment according to FIG. 8*a* with a drive unit.
Figure 8D:
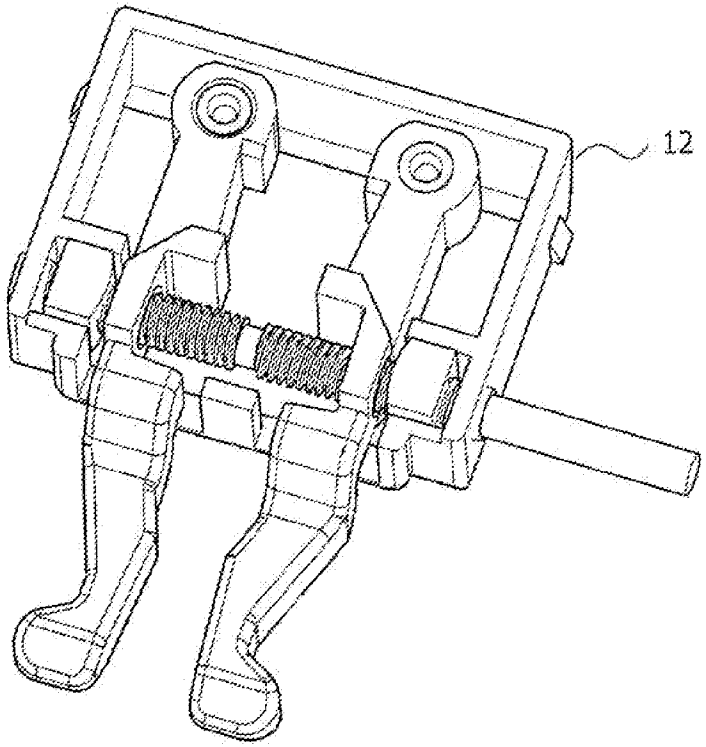
FIG. 8*d* is a diagrammatic representation of a lateral plan view of the component of the door lock according to the seventh embodiment according to FIG. 8*a*.
Figure 8E:
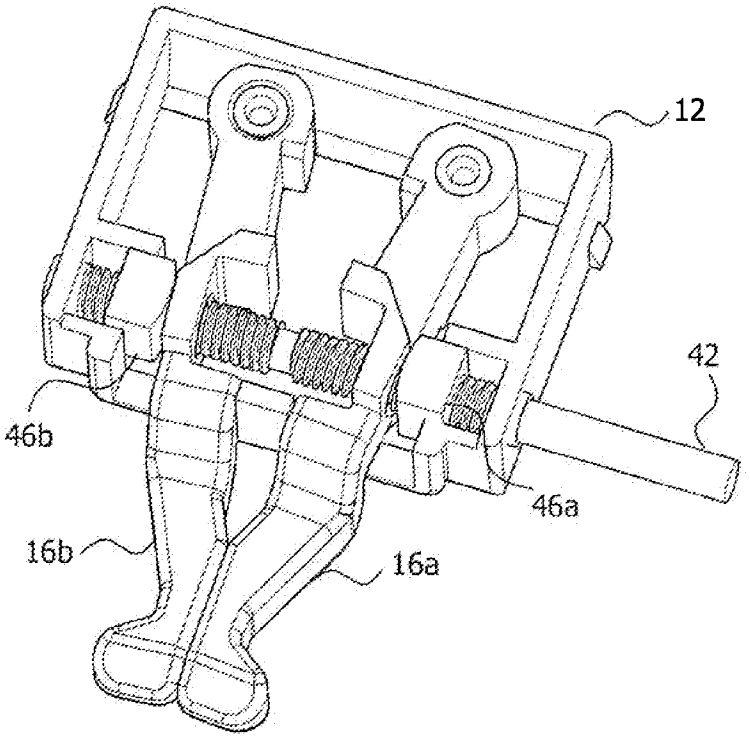
FIG. 8*e* is a diagrammatic representation of a lateral plan view of the component of the door lock according to the seventh embodiment according to FIG. 8*a* in an open position.

FIGS. 8*a* to 8*e* show a closing unit 10 of the door lock according to a seventh embodiment. In this seventh embodiment a threaded rod 42 having a contradirectional righthand-/lefthand thread 44 is inserted through the closing arms 14*a*, 14*b* transversely of the longitudinal direction of the closing arms 14*a*, 14*b*. As may be seen in FIG. 8*c*, the threaded rod 42 is connected to a drive unit configured for example as electric motor 50 for driving the threaded rod 42. Two slide blocks 46*a*, 46*b* disposed in a rotationally fixed manner on the threaded rod 42 are moreover situated in the housing 12. In the case of the use of a compression spring 22 the slide blocks 46*a*, 46*b* are disposed outside of the outer surfaces of the closing arms 14*a*, 14*b*. The compression spring 22 surrounds the thread 44 of the threaded rod 42. A control unit 52 is moreover diagrammatically indicated in FIG. 8*c*. The control unit 52 may be for example a control unit that is responsible for controlling the dishwashing machine. Alternatively the control unit 52 may be provided in the door lock or be connected thereto and receive instructions from the control unit of the dishwashing machine. The control unit 52 is connected to the electric motor 50 in such a way that it may communicate instructions to the electric motor 50. These instructions may include the duration of rotation of the electric motor 50, the speed of rotation, the number of rotations as well as the start point and end point of rotation and similar parameters. Further indicated in FIG. 8*c* is a compression spring 56, which in turn is connected to an ejection pin 54. The spring 56 in its normal position is preloaded counter to its spring action acting in the direction of the direction of extent of the closing arms 14*a*, 14*b*.

If the control unit 52 then detects that the washing operation has finished and the drying operation is to be initiated, the control unit 52 activates the electric motor 50, which then brings about a rotation of the threaded rod 42. As a result of the rotation of the threaded rod 42 the slide blocks 46*a*, 46*b* disposed in a rotationally fixed manner on the threaded rod 42 are not only co-rotated with the threaded rod 42 but are also moved towards the compression spring 22. As a result of the movement of the slide blocks 46*a*, 46*b* the closing arms 14*a*, 14*b* are pressed together counter to the action of the compression spring 22 until the free arm portions 16*a*, 16*b* are situated in an end position. This end position is represented by way of example in FIG. 8*e*. As is evident from FIG. 8*e*, in the end position the free arm portions 16*a*, 16*b* are fully pressed together at their free ends. Once the end position has been reached, the electric motor 50 is switched off by the control unit. As is evident from FIG. 8*e* in combination with FIG. 2*b*, in the end position the free ends of the free arm portions 16*a*, 16*b* are no longer situated in the cavities 36*a*, 36*b* but have moved inwards transversely of the direction of extent of the closing arms 14*a*, 14*b*, removed themselves from the cavities and are therefore no longer form a frictional connection with the cavities 36*a*, 36*b*. Opening of the door 3 is therefore possible with a minimal expenditure of force.

In order to guarantee an automatic opening of the door, the ejection pin 54 may further be provided, which may slightly press the door in the direction of extent of the closing arms and namely in the direction of opening of the door. The ejection pin 54 prior to conclusion of the washing operation is situated in a normal position, in which the compression spring 56 is preloaded. If the control unit 52 instructs the release of the spring 56 (because for example the washing operation has finished and the free arm portions 16*a*, 16*b* have also been sufficiently pressed together), the release of the spring 56 brings about a movement of the ejection pin 54 in the direction of extent of the closing arms 14*a*, 14*b*. As a result of this movement and the associated pressing of the ejection pin 54 against the door, the door is at least slightly pressed open. Consequently, at the start of the drying operation the door may be opened automatically, albeit only minimally, and the drying operation may be carried out more efficiently. Instead of the free arm portions 16*a*, 16*b* being pressed fully together, a comfort opening function of the dishwashing machine may also be achieved by the control unit 52 instructing only a lower rotation of the electric motor 50. The lower rotation of the electric motor 50 results in the free arm portions 16*a*, 16*b* being pressed together to a lesser extent. In this position, during opening of the door there is still a slight contact of the free arm portions 16*a*, 16*b* with the inner surfaces of the closing mouth 32. However, compared to the normal position of the closing arms 14*a*, 14*b* the friction is markedly reduced, thereby enabling an easier opening of the door with a reduced expenditure of force.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A door lock for a dishwashing machine, the door lock comprising:

a lock housing;

a pair of closing arms held in the lock housing, each closing arm having a free arm portion projecting from the lock housing, wherein the free arm portions are deflectable relative to one another from a relative normal position in a relative first deflection direction counter to a resetting action of at least one first spring;

a pair of deflection surfaces, each deflection surface configured for engagement by a respective one of the free arm portions during closing of a door of the dishwashing machine, the deflection surfaces effective to cause a relative deflection of the free arm portions counter to the resetting action of the first spring, wherein the free arm portions, during closing of the door and following their relative deflection by the deflection surfaces, move past the deflection surfaces and in so doing experience an at least partial resetting in the direction of the relative normal position when the door is in a closed state; and a motor-driven opening mechanism configured to act upon the closing arms when the door is in the closed state to deflect the free arm portions relative to one another against the resetting action of the first spring; and a control unit configured to activate the motor-driven opening mechanism if it is detected that a washing operation of the dishwashing machine has finished and a drying operation is to be initiated.

2. The door lock according to claim 1 wherein the deflectability of the free arm portions is based at least partially on an inherent flexibility of the closing arms.

3. The door lock according to claim 1 wherein the deflectability of the free arm portions is based at least partially on a movable mounting of the closing arms in the lock housing.

4. The door lock according to claim 1 wherein the free arm portions of the closing arms carry roll-mounted rolling elements that provide a rolling contact of the free arm portions with the deflection surfaces.

5. The door lock according to claim 1 wherein the free arm portions are deflectable from their relative normal position towards one another and the deflection surfaces converge towards one another so as to deflect the free arm portions towards one another.

6. The door lock according to claim 5 wherein the first spring comprises one of a helical compression spring and a helical tension spring.

7. The door lock according to claim 1 wherein the free arm portions are deflectable from the relative normal position away from one another, and the deflection surfaces diverge away from one another so as to deflect the free arm portions away from one another.

8. The door lock according to claim 7 wherein the first spring comprises a helical tension spring.

9. The door lock according to claim 1 wherein in the normal position the mutual spacing of the free arm portions is determined by a connecting bridge which blocks the free arm portions in the normal position thereof to prevent a relative movement in a second relative deflection direction opposed to the first relative deflection direction.

10. The door lock according to claim 9 wherein in the normal position the free arm portions in a direction corresponding to the second relative deflection direction possess motional clearance relative to the lock housing.

11. The door lock according to claim 1 further comprising a blocking element configured for manual actuation by a manual activation element, wherein the blocking element is displaceable by the manual activation element between a first position and a second position relative to the lock housing, wherein in the first position the blocking element allows for a facilitated relative deflection of the arm portions of the closing arms in the first relative deflection direction, and wherein in the second position the blocking element allows for a relative deflection of the arm portions in the first relative deflection direction that is more difficult compared to the first position of the control element.

12. The door lock according to claim 11 wherein in the closed state of the door the control element is displaceable from its first position into its second position and vice versa.

13. The door lock according to claim 11 wherein the control element in its first position enables a pivoting of the closing arms and in its second position prevents the closing arms from pivoting.

14. The door lock according to claim 1 further comprising a contacting element configured to be activated by one of the free arm portions of the closing arms in order thereby to actuate a switch disposed in the door lock.

15. The door lock according to claim 1 wherein the opening mechanism includes a drive motor and is configured to convert a rotary motion generated by the drive motor to a translatory motion acting upon the closing arms in a way that brings about a deflection of the free arm portions relative to one another counter to the resetting action of the first spring.

16. The door lock according to claim 15 wherein the opening mechanism comprises a threaded rod, which extends transversely of the closing arms through the closing arms and is rotatable with the aid of the drive motor, wherein load transfer elements, which are disposed in a rotationally fixed manner on the threaded rod, as a result of rotation of the threaded rod bring about a deflection of the free arm portions relative to one another counter to the resetting action of the first spring.

17. The door lock according to claim 15 wherein the opening mechanism comprises an ejection member biased by a second spring and configured to push against the door upon release of the second spring member.

18. The door lock of claim 17, wherein the opening mechanism comprises an electric control unit configured to control release of the second spring member.

19. The door lock of claim 1, comprising a closing mouth into which the free arm portions of the closing arms plunge upon closing of the door, wherein the deflection surfaces are formed in the closing mouth.

* * * * *